US006085756A

United States Patent [19]

Sexton et al.

[11] Patent Number: 6,085,756

[45] Date of Patent: Jul. 11, 2000

[54] METHOD AND APPARATUS FOR PAINTING NAILS

[76] Inventors: David John Sexton; Deborah Lee Sexton, both of 21145 Woodland Glen Dr. #103, Northville, Mich. 48167

[21] Appl. No.: 09/362,513

[22] Filed: Jul. 28, 1999

[51] Int. Cl.[7] ..... A45D 29/00

[52] U.S. Cl. ..... 132/73; 132/285; 132/73.5

[58] Field of Search ..... 132/73, 73.5, 75, 132/75.3, 75.6, 76.5, 285, 200

[56] References Cited

U.S. PATENT DOCUMENTS 2,485,384 10/1949 Klein ..... 132/285
5,577,521 11/1996 Neitlich ..... 132/285
5,613,507 3/1997 Geer et al. ..... 132/285
5,803,094 9/1998 Becker et al. ..... 132/200
5,823,205 10/1998 Stankovic ..... 132/285

*Primary Examiner*—Gene Mancene
*Assistant Examiner*—Pedro PhiloGene
*Attorney, Agent, or Firm*—Chupa & Alberti, P.C.

[57] ABSTRACT

A apparatus 10 for painting nails is provided. The nail polishing apparatus includes a substantially "U"-shaped nail abutting portion 12 and an integrally formed substantially "V"-shaped portion 14. Portion 12 includes a slot 18 into which a user can insert a finger 68. Surface 16 of portion 12 effectively covers the skin and/or cuticles 78, 80 surrounding the finger nail 72, thereby preventing unnecessary application of nail polish to these areas. Portion 14 is adapted to pivotally support finger 68 and nail 72 at some distance above a surface 68.

8 Claims, 5 Drawing Sheets

METHOD AND APPARATUS FOR PAINTING NAILS

BACKGROUND OF THE INVENTION

1. Field of the Invention

This invention relates to a method and an apparatus for painting nails, and more particularly, to a method and an apparatus which is adapted to be selectively and abuttingly placed around a user's nail and to allow paint and/or polish to be relatively quickly and efficiently applied to a nail while substantially preventing paint from being applied or transferred to skin, cuticles or other surfaces adjacent to or surrounding the nail.

2. Background

Individuals often decorate their fingernails and toenails for cosmetic purposes. One common method of nail decoration is to apply paint or polish to nail. This paint or "nail polish" is typically and selectively applied to the nail with a brush or other apparatus adapted to coat the nail with polish.

Typically, such nail painting brushes or apparatuses are incorporated into the cap of a nail polish bottle or container. The cap of the container is removed and the brush is selectively inserted in to the container, thereby operatively coating the brush with nail polish. The brush is then applied to the nail, thereby selectively transmitting the polish onto the nail. While this prior method and apparatus are effective to apply paint or polish to fingernails and toenails, they suffer several undesirable drawbacks.

For example, using the afore-described method and apparatus often causes polish to be undesirably transferred to cuticles and/or skin located adjacent to the nail on which the polish is being applied. Particularly, when the brush is applied directly to the nail, oftentimes the brush contacts the skin and/or cuticles that surround the nail. As a result, the surrounding skin and/or cuticles receive undesirable and unsightly amounts of polish. Additionally, while using the prior method and apparatus, excess polish often undesirably spills, drips, or "splatters" off of the end of the nail or the brush and onto the skin and other surrounding areas. The unwanted polish is generally removed from the skin, cuticles and/or other surrounding areas or surfaces by way of an abrasive tool or a chemical nail polish removing solution. Removing this unwanted polish requires excessive time and exposes the skin, cuticles and other surfaces to potentially harmful chemicals and/or abrasives. Furthermore, the significant amount time and effort required to carefully apply nail polish without having any significant amount of unwanted polish contacting the adjacent skin, cuticles and or other surfaces is inefficient, undesirable, and wasteful.

There is therefore a need to provide a nail painting method and apparatus which overcomes some or all of the difficulties and drawbacks associated with the previously delineated prior methods and apparatuses; which substantially prevents unwanted paint and/or polish from contacting the skin and cuticles surrounding the nail; which allows for the relatively efficient, neat, and quick application of polish to a nail; and which is relatively inexpensive to manufacture and easy to use.

SUMMARY OF THE INVENTION

It is therefore a first object of this invention to provide a nail painting method and an apparatus which overcomes at least some of the drawbacks related to prior nail painting methods and apparatuses.

It is a second object of this invention to provide a nail painting method and an apparatus which substantially prevents unwanted paint and/or polish from contacting the skin and cuticles surrounding the nail.

It is a third object of this invention to provide a nail painting method and an apparatus which allows for relatively efficient, neat, and quick application of paint to a nail.

It is a fourth object of this invention to provide a nail painting method and an apparatus which may be manufactured relatively inexpensively and which is relatively simple to use.

It is a fifth object of this invention to provide a nail painting method and an apparatus which may be easily and cooperatively stored in conjunction with a bottle of nail polish or upon a finger.

According to a first aspect of the present invention, an apparatus for use in painting a nail which is disposed upon a finger having a certain amount of skin which surrounds the nail, and adapted for use in combination with an amount of paint and an applicator for applying the paint to the nail, is provided. The device includes a first portion having a nail contacting edge which conformingly fits beneath a portion of the nail. The first portion is effective to selectively cover at least some of the certain amount of skin and to prevent the paint from contacting the at least some of the certain amount of skin while paint is being applied to the nail by way of the applicator.

According to a second aspect of the invention, the device further includes a second portion which extends from the first portion at a certain angle. The s second portion includes an end which engages a surface, thereby pivotally supporting the first portion, the finger, and the nail while the paint is being applied to the nail.

Further objects, features, and advantages of the present invention will become apparent from consideration of the following description and the appended claims, when taken in conjunction with the accompanying drawings.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT

Figure 1:
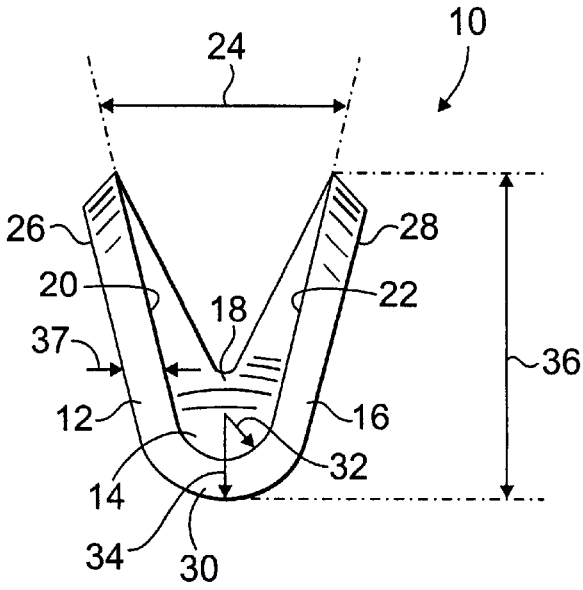
FIG. 1 is a front view of a nail painting device made in accordance with the preferred embodiment of the invention.

Referring to FIGS. 1–4, there is shown a top view of the nail painting or polishing device or apparatus 10 made in accordance with the teachings of the preferred embodiment of the present invention. It should be appreciated that a substantially identical assembly 10 may be selectively used upon various sizes, types, and shapes of nails and that while the following discussion describes the use of apparatus 10 upon a fingernail, it is equally applicable to use upon thumbnails and toenails. Apparatus 10 includes a nail abutting portion 12 and a support portion 14. In the preferred embodiment of the invention, portions 12 and 14 are integrally formed together from a relatively resilient/flexible and durable material, such as steel, plastic, polyeurothane, or any other suitable metal, synthetic or composite material. In other alternate embodiments, portions 12 and 14 are coupled together in a conventional manner such as by welding, by use of a conventional adhesive, by bonding, by sintering, or by any other suitable technique. In one non-limiting embodiment, apparatus 10 is formed from a lustrous metal material having a substantially uniform thickness of approximately 0.02 inches. In other embodiments of the invention, the nail painting apparatus 10 is formed from a colored material having a decorative pattern.

Figure 5:
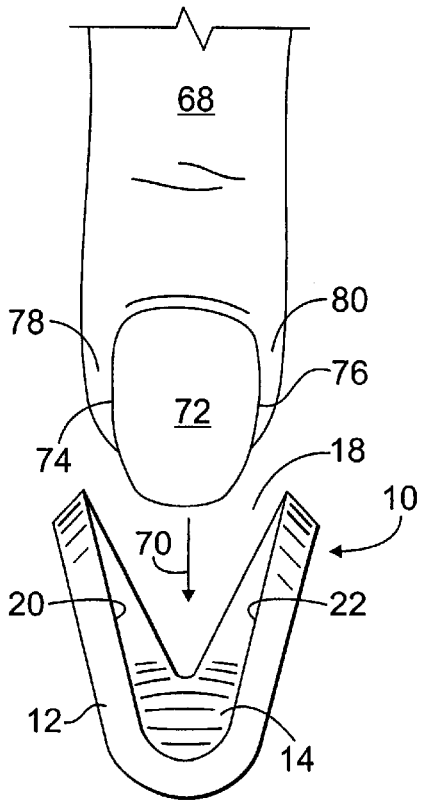
FIG. 5 is a front view of the nail painting device shown in FIG. 1 illustrating a finger being inserted into the device.

In the preferred embodiment of the invention, nail abutting portion 12 is substantially "U"-shaped in design. Portion 12 includes a top nail contacting surface 16, and two opposing inner edges 20 and 22, which are disposed at an angle 24 in respect to each other. In the preferred embodiment of the invention, angle 24 is approximately 30 degrees. Inner edges 20, 22 cooperatively form a substantially "U"-shaped finger receiving slot 18, which, as described more fully and completely below, operatively, selectively, abuttingly, and conformingly receives a finger 68 and finger nail 72, (e.g., see FIGS. 5 and 6). Outer edges 26, 28 are respectively disposed in a substantially parallel relationship to inner edges 20, 22. Portion 12 further includes a nail tip contacting end portion 30. Portion 30 is substantially semicircular in shape and has an inner bend radius 32 and an outer bend radius 34. In the preferred embodiment of the invention, inner bend radius 32 is approximately 0.12 inches in length, and outer bend radius 34 is approximately 0.23 inches in length. Portion 12 has an overall length 36, which in the preferred embodiment of the invention is approximately 0.85 inches; and a thickness 37, which in the preferred embodiment of the invention is approximately 0.11 inches and is substantially uniform throughout portion 12.

Figure 2:
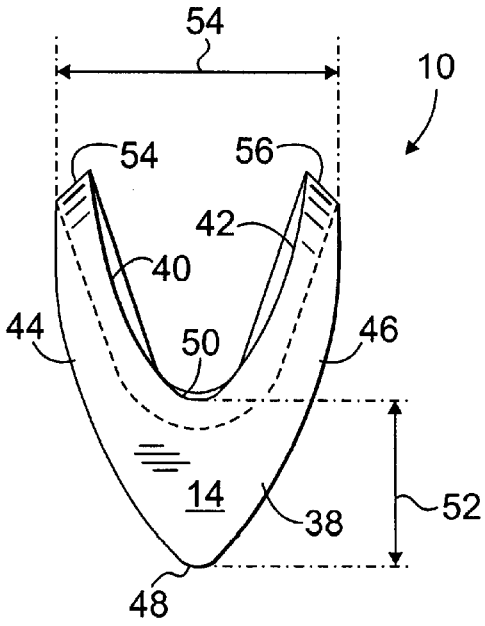
FIG. 2 is a back view of the nail painting device shown in FIG. 1.
Figure 3:
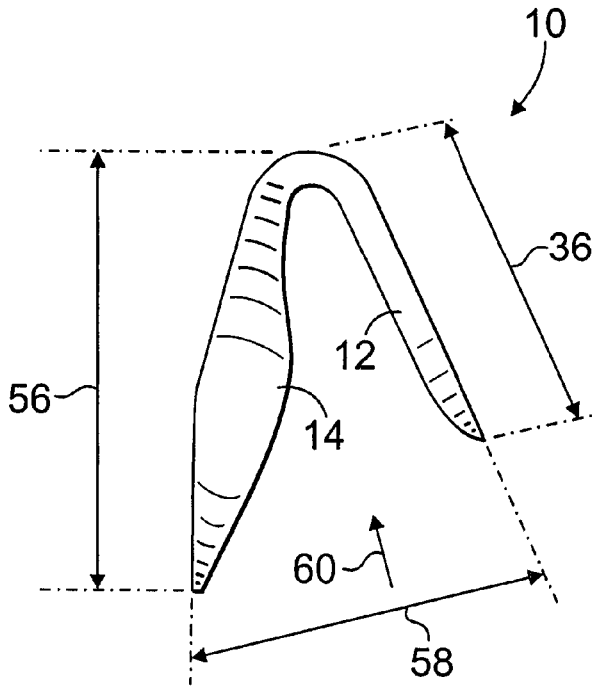
FIG. 3 is a side view of the nail painting device shown in FIG. 1.

As best shown in FIG. 2, portion 14 is generally "V"-shaped. Portion 14 includes a top surface 38, two opposing inner edges 40 and 42, and two opposing outer edges 44 and 46. Outer edges 44, 46 terminate at a support point or end 48, and inner surfaces 40, 42 terminate at a point 50. In the preferred embodiment of the invention, the distance 52 between points 48 and 50 is approximately 0.47 inches. In the preferred embodiment of the present invention, portion 14 has an overall width 54 of approximately 0.75 inches, and an overall length 56 of 1.10 inches, as shown in FIG. 3. While in the preferred embodiment of the invention, point 48 is pointed, in alternate embodiments, point 48 may be substantially rounded or flat.

Portions 12 and 14 are integrally connected along surfaces 54 and 56. Portions 12 and 14 are disposed in respect to each other at an acute angle 58, which, in the preferred embodiment of the invention, is equal to approximately 25 degrees. It should be appreciated that in alternate embodiments, other angles, shapes, and dimensions may be used for apparatus 10.

Figure 4:
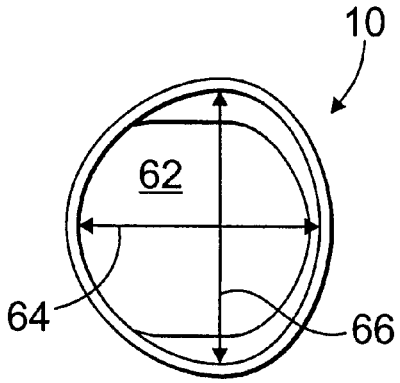
FIG. 4 is bottom view of the nail painting device shown in FIG. 1.

As best shown in FIG. 4, when viewed in the direction of arrow 60 (shown in FIG. 2) portions 12 and 14 cooperatively form a generally oblong, elliptical, or oval-shaped aperture 62. Aperture 62 has a width 64, which in the preferred embodiment of the invention has a maximum value of approximately 0.62 inches, and which is gradually tapered over the length of the device. Aperture 62 further has a maximum length 66, which in the preferred embodiment of the invention has a maximum value of approximately 0.75 inches, and which is likewise gradually tapered over the length of the device.

Figure 6:
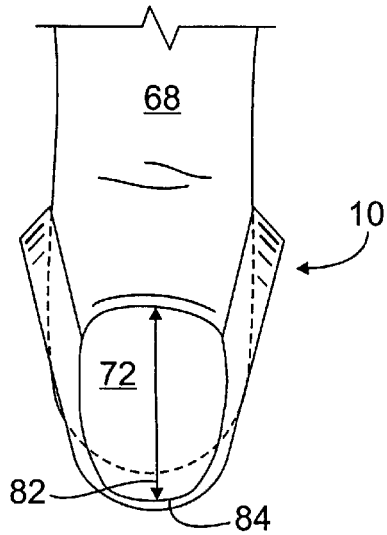
FIG. 6 is a front view of the nail painting device shown in FIG. 1 operatively placed upon a finger.

The operation and functionality of the preferred embodiment of apparatus 10 is illustrated in FIGS. 5–9. As shown best in FIG. 5 and 6, in operation, a user selectively inserts a finger 68 into slot 18 in the direction shown by arrow 70. As finger 68 is received by slot 18, edges 20, 22 respectively and conformingly, and/or expansively slide underneath and/or operatively abut the opposed edges 74, 76 of nail 72. As best shown in FIG. 6, once finger 68 is fully inserted into slot 18, surface 16 and edges 20, 22 respectively abut and/or reside underneath the opposed edges 74, 76 of nail 72 over substantially the entire length 82 of nail 72 (e.g., edges 20, 22 are substantially coextensive to edges 74, 76). In this manner, surface 16 of portion 12 operatively and protectively overlays the skin and/or cuticle portions 78, 80 adjacent to nail 72. Furthermore, the end portion 30 of portion 12 is disposed immediately and abuttingly underneath tip 84 of nail 72, thereby operatively covering and/or protecting the skin residing underneath and/or around tip 84 of nail 72.

Figure 7:
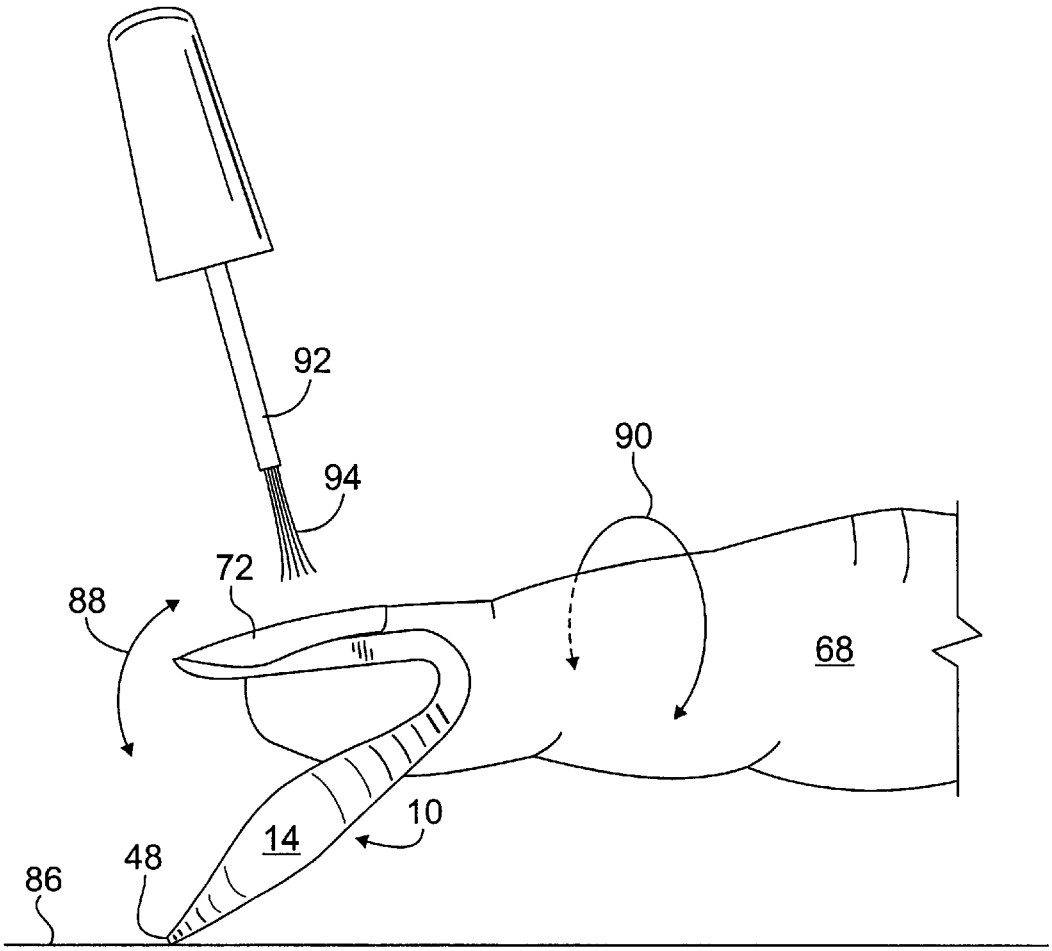
FIG. 7 is side view of the nail painting device shown in FIG. 1 operatively placed upon a finger and resting upon a surface.

Once apparatus 10 is selectively and operatively placed upon finger 68, support portion 14 and more particularly support point or end 48 is selectively placed and/or rested upon a preferably flat and/or level surface 86. In this manner, finger 68 and nail 72 are operatively and effectively supported above surface 86, as shown in FIG. 7, thereby providing a user to maintain finger 68 and nail 72 in a "stable" position while applying paint or polish to nail 72. Substantially "pointed" end 48 of portion 14 also allows a user to supportably, desirably, and selectively pivot finger 68 and nail 72 in the directions illustrated by arrows 88 and 90, thereby providing the user with a multitude of independently stable angles and positions for painting nail 72. Nail paint or polish is then selectively applied to nail 72 by way of a conventional nail polish applicator, such as a brush 92. A user selectively applies nail polish to nail 72 by way of brush 92, and more particularly by dipping end 94 of brush 92 into an amount of polish, and subsequently and selectively applying end 94 to nail 72 in a stroking fashion, thereby effectively communicating amounts of polish to the nail 72. With apparatus 10 securely and operatively disposed upon finger 68, thereby effectively and protectively covering adjacent skin areas 78, 80, brush 94 may be easily and quickly moved across nail 72 without polish undesirably contacting areas 78, 80.

Furthermore, as brush 92 applies paint or polish to nail 72 and reaches the end or tip 84 of nail 72, excess or residual polish is communicated to portion 30 of apparatus 10 rather than being undesirably communicated to the skin underlying tip 84 and/or to the surface 86 beneath tip 84. Once a nail 72 has been completely painted, apparatus 10 is removed from finger 68 and is cleaned by way of a conventional and commercially available solvent or "nail polish remover" and/or by way of a tissue, rag, cotton ball or other conventional removal device. Once apparatus 10 has been cleaned, it can be operatively attached to another finger, thumb or toe, or stored for later use.

Figure 8:
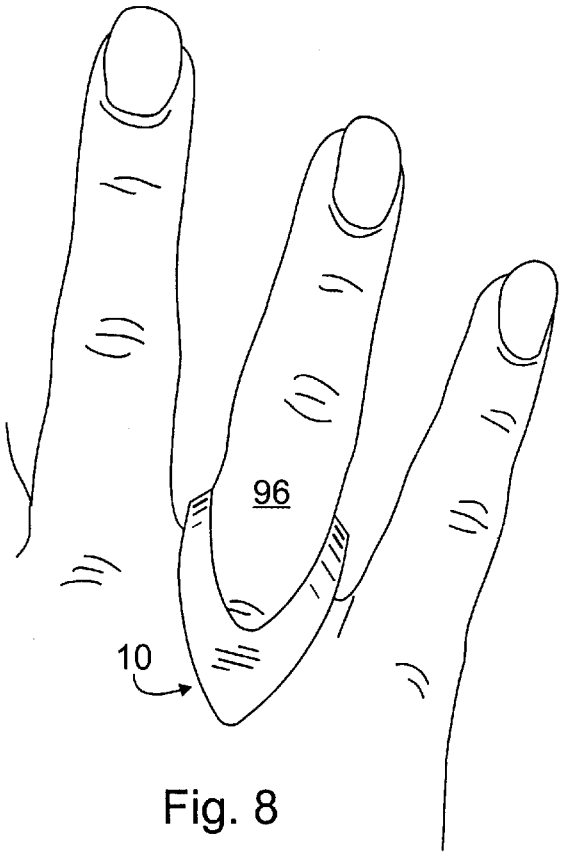
FIG. 8 is a top view of the nail painting device shown in FIG. 1 being worn upon a finger.

One method of storing apparatus 10 is illustrated in FIG. 8. Particularly, apparatus 10 can be placed upon a finger 96 and worn as a "ring" or piece of decorative jewelry. In order to place apparatus 10 onto finger 96, finger 96 is selectively inserted into aperture 62 in the direction shown by arrow 60 of FIG. 3, and apparatus 10 is slid down finger 96 until it is conformingly, abuttingly, and/or frictionally secured onto finger 96, as shown in FIG. 8.

Figure 9:
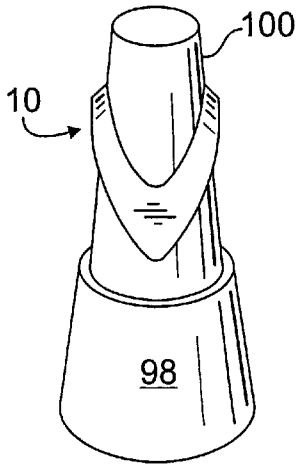
FIG. 9 is a side view of the nail painting device shown in FIG. 1 disposed upon the cap of a nail polish container.

An alternate method of storing apparatus 10 is illustrated in FIG. 9. In FIG. 9 there is shown a conventional and commercially available nail polish or paint bottle 98 which includes a cap 100 which is operatively and selectively secured to bottle 98. While apparatus 10 is not being used, it can be selectively stored on cap 100 by selectively inserting cap 100 into aperture 62 in the direction shown by arrow 60 of FIG. 3, and sliding apparatus 10 down cap 100 until it is conformingly, abuttingly, and/or frictionally secured onto finger cap 100, as shown in FIG. 9.

Those skilled in the art can now appreciate from the foregoing description that the broad teachings of the present invention can be implemented in a variety of forms and dimensions. For example and without limitation, in one non-limiting embodiment, substantially "V"-shaped portion 14 is replaced with a second substantially "U"-shaped portion which is substantially similar to portion 12, except that the second "U"-shaped portion is of a different size, thereby providing the user with a different sized slot to better conform to different sized or shaped nails. It should be further appreciated that different shapes can be used for portions 12 and 14 to conform to different types and/or shapes of nails. Therefore, while this invention has been described in connection with particular examples thereof, the true scope of the invention should not be so limited since other modifications will become apparent to the skilled practitioner upon a study of the drawings, specification and following claims.

What is claimed is:

1. A device for painting a nail having two sides and being disposed upon a finger having a certain amount of skin surrounding said nail, and adapted for use over a surface and in combination with an amount of paint which is applied to said nail, said device comprising:

a first portion having a nail contacting edge which conformingly fits beneath a portion of said nail and conformingly abuts at least some of said sides of said nail, said first portion being effective to cover at least some of said certain amount of skin, thereby preventing said paint from contacting said at least some of said skin when said paint is applied to said nail; and a second portion extending from said first portion, said second portion having first end for pivotally contacting said surface, thereby rotatably supporting said first portion, said second portion, and said nail.

2. The apparatus of claim 1 wherein said first portion is substantially "U" shaped.

3. The apparatus of claim 1 wherein said first portion is made of a flexible material.

4. The apparatus of claim 1 wherein said second portion is substantially "V"-shaped.

5. A one-piece apparatus for painting a nail being disposed upon a finger having a certain amount of skin which surrounds said nail, and adapted for use over an independently supported surface and in combination with an amount of paint which is applied to said nail, said apparatus comprising:

a first portion having a surface which conformingly fits upon said finger and beneath a portion of said nail, effective to cover at least some of said certain amount of skin, thereby preventing said paint from contacting said at least some of said certain amount of skin while said paint is applied to said nail; and a second portion which is integrally formed with said first portion and which extends from said first portion at a certain angle, said second portion having a first end which is substantially pointed and which contacts said surface, thereby pivotally supporting said first portion, said finger, and said nail while said paint is being applied to said nail.

6. The apparatus of claim 5, wherein said first portion and said second portion cooperatively form an aperture.

7. The apparatus of claim 6 wherein said apparatus is shaped to abuttingly receive a nail polish bottle cap, thereby allowing said apparatus to be disposed upon said nail polish bottle cap.

8. The apparatus of claim 6 wherein said apparatus is shaped to abuttingly receive said finger, thereby allowing said apparatus to be worn on said finger.

* * * * *